US008120273B2

(12) United States Patent
Edwards

(10) Patent No.: US 8,120,273 B2
(45) Date of Patent: Feb. 21, 2012

(54) LIGHT CONTROL SYSTEM WITH PWM DUTY CYCLE CONTROL USING CURRENT SIGNAL FEEDBACK

(75) Inventor: Daniel Robert Edwards, Ypsilanti, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 617 days.

(21) Appl. No.: 12/259,313

(22) Filed: Oct. 28, 2008

(65) Prior Publication Data

US 2010/0102746 A1 Apr. 29, 2010

(51) Int. Cl.
*H05B 37/02* (2006.01)

(52) U.S. Cl. ..... 315/291; 315/185 R; 315/225; 315/360

(58) Field of Classification Search ..... 315/185 R, 315/225, 307, 360, 291
See application file for complete search history.

(56) References Cited

U.S. PATENT DOCUMENTS

| | | | | |
|---|---|---|---|---|
| 6,897,771 | B1 | 5/2005 | Lodhie et al. | |
| 7,235,954 | B2 * | 6/2007 | Murakami | 323/222 |
| 7,358,679 | B2 | 4/2008 | Lys et al. | |
| 7,425,088 | B2 | 9/2008 | Weitzel | |
| 7,659,672 | B2 * | 2/2010 | Yang | 315/224 |
| 7,906,943 | B2 * | 3/2011 | Isobe et al. | 323/223 |
| 2004/0051918 | A1 * | 3/2004 | Sato et al. | 358/509 |

* cited by examiner

*Primary Examiner* — James H Cho
(74) *Attorney, Agent, or Firm* — Fraser Clemens Martin & Miller LLC; J. Douglas Miller

(57) ABSTRACT

A light control system having a light emitting device to produce a pre-determined light output is disclosed. The light control system includes a power circuit in electrical communication with the light emitting device for transmitting an electrical current to the light emitting device for controlling the light output, a timing circuit in electrical communication with the power circuit, wherein the timing circuit generates a pre-determined timing sequence and regulates a duty cycle of the power circuit in response to the timing sequence, and a feedback circuit in communication with the light emitting devices and the timing circuit, wherein the feedback circuit is adapted to monitor an electrical characteristic of the light emitting devices and control the timing sequence of the timing circuit in response to the electrical characteristics of the light emitting devices.

20 Claims, 2 Drawing Sheets

LIGHT CONTROL SYSTEM WITH PWM DUTY CYCLE CONTROL USING CURRENT SIGNAL FEEDBACK

FIELD OF THE INVENTION

The present invention relates to lighting. More particularly, the invention is directed to a lighting system and method for controlling a duty cycle of the lighting system.

BACKGROUND OF THE INVENTION

Creating a brake light and a tail light function for Light Emitting Diode (LED) automotive tail lamps that use the same LEDs for a tail mode and a brake mode requires that the LEDs be driven "ON" to a lesser degree for the tail mode than for the brake mode. The partially "ON" tail mode can be achieved by principles of Pulse Width Modulation (PWM), wherein the LEDs are "ON" for less than 10% of the time. The PWM timing can be implemented by pulsing the LED driver ON/OFF in an open loop fashion from a timing source. Unfortunately, when the LED driver is a switchmode power supply (SMPS), there can be variability in the time it takes to start-up and shut-down the power supply, especially if the SMPS has soft start or is commanded from its soft start control circuits. The variation in the start-up/shut-down time of the power supply impacts the duty cycle performance of a resultant PWM waveform. Specifically, SMPS circuits take time to start-up and shut-down. The start-up and shut-down time changes in response to external conditions such as ambient temperature, input voltage, and load.

A constant PWM duty cycle of an output of the power supply is desirable for combination tail mode and brake mode LEDs. Open loop PWM of the power supply circuits from a soft-start control input allows the duty cycle to drift due to varying start-up and shut-down delay times in the power circuits. A drifting duty cycle causes a drifting perception and measurement of the brightness of the tail mode LEDs.

It would be desirable to have a light control system and a method for controlling a duty cycle of the light control system wherein the duty cycle provides a substantially continuous and stable power "ON" (duty cycle) and thereby a light output having a stable and continuous perceived brightness.

SUMMARY OF THE INVENTION

Concordant and consistent with the present invention, a light control system and a method for controlling a duty cycle of the light control system, wherein the duty cycle provides a substantially continuous and stable power "ON" (duty cycle) and thereby a light output having a stable and continuous perceived brightness, has surprisingly been discovered.

In one embodiment, a light control system comprises: a light emitting device for producing a predetermined light output; a power circuit in electrical communication with the light emitting device for selectively transmitting an electrical current to the light emitting device for controlling the light output; a timing circuit in electrical communication with the power circuit, wherein the timing circuit generates a pre-determined timing sequence and regulates a duty cycle of the power circuit in response to the timing sequence; and a feedback circuit in communication with the light emitting devices and the timing circuit, wherein the feedback circuit is adapted to monitor an electrical characteristic of the light emitting devices and control the timing sequence of the timing circuit in response to the electrical characteristics of the light emitting devices.

In another embodiment, a light control system comprises: a light emitting device for producing a first light output and a second light output; a power circuit in electrical communication with the light emitting device for selectively transmitting an electrical current to the light emitting device for controlling the first light output and the second light output; a timing circuit in electrical communication with the power circuit, wherein the timing circuit generates a pre-determined timing sequence and regulates a duty cycle of the power circuit in response to the timing sequence; and a feedback circuit in communication with the light emitting devices and the timing circuit, wherein the feedback circuit is adapted to monitor an electrical characteristic of the light emitting devices and control the timing sequence of the timing circuit in response to the electrical characteristics of the light emitting devices.

The invention also provides methods for controlling a duty cycle of a light control system.

One method comprises the steps of: providing a light emitting device for generating a light output; generating a timing sequence; transmitting an electrical current to the light emitting device in response to the timing sequence, wherein the light emitting device generates the light output in response to the transmitted electrical current; monitoring the electrical current flowing through the light emitting device; generating a feedback signal in response to a pre-determined monitoring threshold based upon the electrical current flowing through the light emitting device; and modifying the timing sequence in response to the feedback signal.

BRIEF DESCRIPTION OF THE DRAWINGS

The above, as well as other advantages of the present invention, will become readily apparent to those skilled in the art from the following detailed description of the preferred embodiment when considered in the light of the accompanying drawings in which.

DETAILED DESCRIPTION OF EXEMPLARY EMBODIMENTS OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
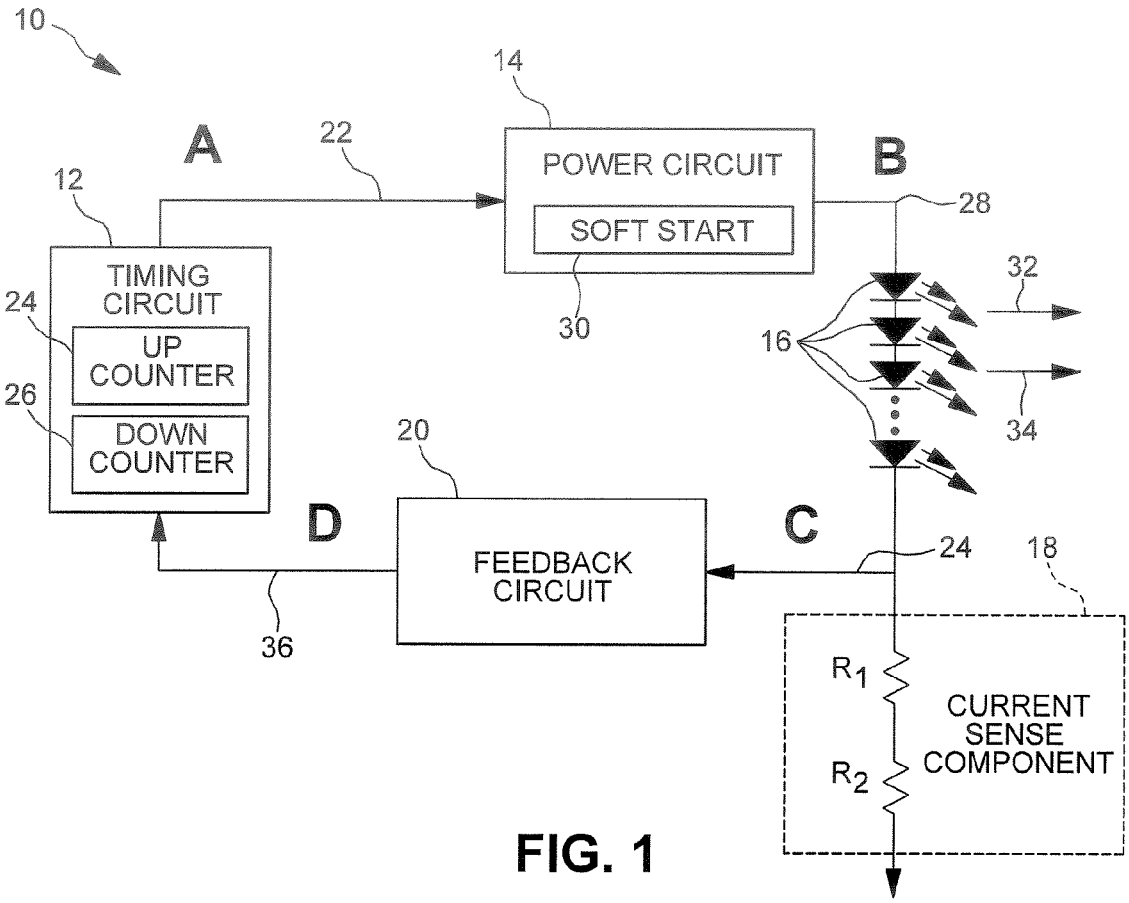
FIG. 1 is a schematic block diagram of a light control system according to an embodiment of the present invention.

FIG. 1 illustrates a light control system 10 including a timing circuit 12, a power circuit 14, a plurality of light emitting devices 16, a current sense component 18, and a feedback circuit 20. It is understood that the light control system 10 may include additional components and circuits.

The timing circuit 12 or integration circuit is in electrical communication with the power circuit 14 and is adapted to generate and transmit a power toggle signal 22 to the power circuit 14 for controlling the operation of the power circuit 14. The timing circuit 12 may be any circuit adapted to generate and set a sequential timing, analog or digital, for associated electronic circuits. As a non-limiting example, the timing circuit 12 is a 555 timer circuit, known in the art. As a further example, the timing circuit 12 may be a programmable timer chip adapted to function as a single or a multi function unit. However, other circuits, arrangements, and devices may be used, as desired. In the embodiment shown, the timing circuit 12 includes an up counter component 24 and a down counter component 26. It is understood that the timing circuit 12 may include any number of sequencing components and may generate any timing sequence including a bidirectional sequencing, for example. It is further understood that the timing circuit 12 may be adapted to operate as an astable, monostable, or bistable circuit.

The power circuit 14 is in communication with the light emitting devices 16 and is adapted to transmit and control an electrical power 28 transmitted to the light emitting devices 16. As shown, the power circuit 14 includes a soft-start component 30 to limit inrush current or input surge current to a pre-determined value. As a non-limiting example, the power circuit 14 is an LED driver with a built-in soft-start implementation. As a further example, the power circuit 14 may be a switch mode power supply (SMPS) having a duty cycle for producing a pre-determined output current. However, other drivers, power supplies, and circuits may be used, as desired.

The light emitting devices 16 illustrated are light emitting diodes adapted to generate at least one of a pre-determined first light output 32 and a pre-determined second light output 34. It is understood that other devices and elements may be used to generate the at least one of the light outputs 32, 34. It is further understood that any number of light emitting devices 16 may be used. In one embodiment, the light emitting devices 16 are arranged in a pre-determined array to operate as a brake light/tail light combination for a vehicle. As such, the first light output 32 is suitable for use as a tail light function for a vehicle and the second light output 34 is suitable for use as a brake light function for the vehicle. In certain embodiments, the first light output 32 has a perceived brightness that is less than the second light output 34. It is understood that any number of the light emitting devices 16 may be adapted to generate any number of light outputs and patterns, as desired.

The current sense component 18 is in electrical communication with the light emitting devices 16 and the feedback circuit 20. As shown, the current sense component 18 includes a plurality of resistors R1, R2. It is understood that the current sense component 18 may include any number of resistors, as desired. It is further understood that the current sense component 18 may include additional elements and devices for cooperating with the feedback circuit 20 to monitor an electrical characteristic 24 of the light emitting devices 16 such as voltage and current, for example.

The feedback circuit 20 is in electrical communication with the current sense component 18 and the timing circuit 12. As such, the feedback circuit 20 is adapted to monitor the electrical characteristics 24 of the light emitting devices 16 and current sense component 18, and transmit a feedback signal 36 to the timing circuit 12 in response to the monitored electrical characteristics 24. It is understood that the feedback circuit 20 may include any components or devices for measuring and monitoring the electrical characteristics 24 of the light emitting devices 16 and current sense component 18, as desired. It is further understood that the feedback signal 36 may be generated and transmitted in response to a pre-determined current monitoring threshold such as a threshold voltage drop, for example. Other monitoring threshold variables may be used.

Figure 2:
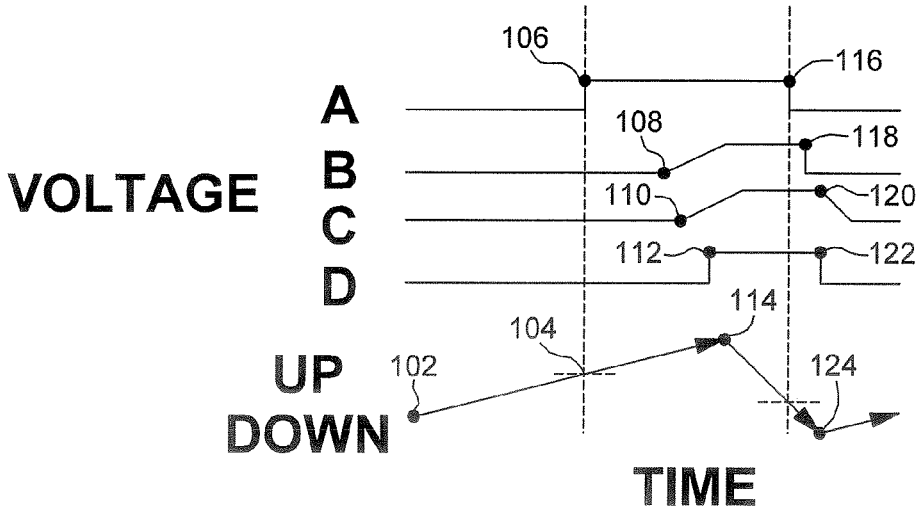
FIG. 2 is a graphical plot of voltage v. time for various points in the light control system of FIG. 1.
Figure 3:
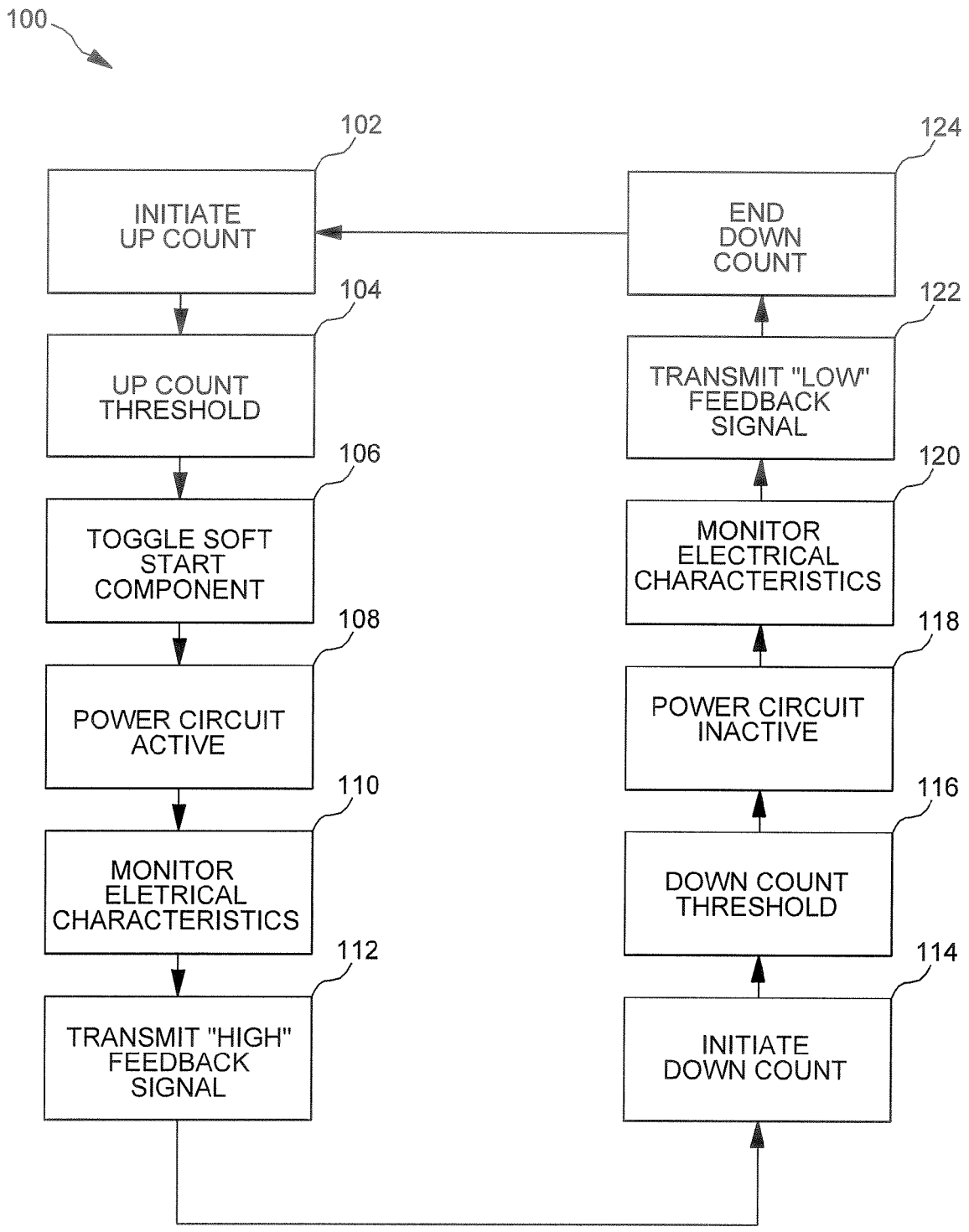
FIG. 3 is a flow diagram of a method for controlling a duty cycle of the light control system of FIG. 1.

Referring to FIGS. 2 and 3, there is illustrated a method 100 for controlling a duty cycle of the light control system 10, and thereby at least one of the light outputs 32, 34 of the light emitting devices 16. Specifically, FIG. 2 illustrates a graphical plot of voltage v. time for various points A, B, C, D in the light control system 10 relative to steps of the method 100.

In step 102, the timing circuit 12 or integration circuit begins an up count timing sequence. In step 104, the up count timing sequence continues until an up count value exceeds a pre-determined up count threshold. It is understood that the up count threshold may have any value, as desired. Once the up count threshold value is exceeded, the timing circuit 12 transmits the power toggle signal 22 to the power circuit 14 wherein the power toggle signal 22 represents an active "HIGH" signal. In step 106, the soft-start component 30 of the power circuit 14 is initiated to an active state in response to the power toggle signal 22. After a pre-determined delay associated with the settings and characteristics of the soft-start component 30, the power circuit 14 starts-up and transmits the electrical power 28 to the light emitting devices 16, as illustrated in step 108. In step 110, an electrical current flows through the light emitting devices 16 and the current sense component 18, wherein the resistors R1, R2 of the current sense component 18 drop a voltage according to Ohm's law. In step 112, the feedback circuit 20 detects the voltage drop and where the pre-determined monitoring threshold is exceeded, the feedback circuit 20 transmits the feedback signal 36, representing an active "HIGH" signal, to the timing circuit 12. In step 114, the timing circuit 12 stops the up count timing sequence and initiates a down count timing sequence, in response to the feedback signal 20. In step 116, the down count timing sequence continues until a down count threshold value is exceeded. It is understood that the down count threshold may have any value, as desired. Once the down count threshold value is exceeded, the timing circuit 12 transmits the power toggle signal 22 to the power circuits 14, wherein the power toggle signal 22 goes LOW and represents a "shutdown" command. In step 118, the power circuit 14 is toggled to an inactive state in response to the "LOW" power toggle signal 22. In step 120, the power circuit 14 shuts down, and thereby the transmission of the electrical power 28 to the light emitting devices 16 is stopped. With substantially no electrical current flowing through the light emitting devices 16 and the current sense component 18, the feedback circuit 20 detects the electrical characteristics 24 representing a low signal, as illustrated in step 120. In step 122, the feedback circuit 20 transmits the feedback signal 36, representing an "LOW" signal, to the timing circuit 12 in response to the substantially no current in the light emitting devices 16 and the current sense component 18. In step 124, the timing circuit 12 ends the down count timing sequence in response to step 122 and begins the up count timing sequence, returning the method 100 to step 102 and continuing the cycle.

As the method 100 continues to cycle, the first light output 32 is generated in accordance with pulse width modulation (PWM) principles known to someone skilled in the art of light control. In one embodiment, the second light output 34 is generated by a full transmission of electrical current, such that the light emitting devices 16 are continuously "ON", while the first light output 34 is generated in response to the constant duty cycle of the power circuit 14 such that the light emitting devices 16 are "ON" for less than 10% of the time. It is understood that the duty cycle may be varied to generate any "ON" timing for the first light output 32. The duty cycle is held substantially constant at the expense of frequency shift and since the human eye perceives brightness based on duty cycle, the constant duty cycle is perceived as constant brightness. Therefore, the first light output 32 is perceived as having a constant brightness that is less than fully "ON".

Additionally, the feedback circuit 20 monitors the electrical characteristics 24 of the light emitting devices 16 and controls the timing sequences of the timing circuit 12 to improve performance of the PWM waveform and to generate the substantially constant duty cycle. It is understood that the duty cycle is based on a slope of the up count timing sequence relative to a slope of the down count timing sequence. Since the slope of the up count timing sequence is independent of any delay in the power circuit 14 and the down count timing sequence begins once the monitoring threshold is detected in the light emitting devices 16, and since the slope of the down count timing sequence is also independent of any delay in the power circuit 14 the light control system 10 effectively adjusts for changes in the time it takes the power circuit 14 to start-up.

Accordingly, the light control system 10 uses feedback or "handshaking" to improve performance of the PWM waveform to generate a constant duty cycle. The improved P M reduces drift in the duty cycle caused by temperature, input voltage, and load. As such, the light control system 10 and method 100 provide a combination brake mode and tail mode functionality for rear LED tail lamps using the same LEDs for tail and brake mode.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. A light control system comprising:

a light emitting device for producing a pre-determined light output;

a power circuit in electrical communication with the light emitting device for selectively transmitting an electrical current to the light emitting device far controlling the light output;

a timing circuit in electrical communication with the power circuit, wherein the timing circuit generates a pre-determined timing sequence and regulates a duty cycle of the power circuit in response to the timing sequence; and a feedback circuit in communication with the light emitting devices and the timing circuit, wherein the feedback circuit is adapted to monitor an electrical characteristic of the light emitting devices and control the timing sequence of the timing circuit in response to the electrical characteristics of the light emitting devices.

2. The light control system according to claim 1, wherein the light output has a pre-determined perceived brightness determined by the duty cycle of the power circuit.

3. The light control system according to claim 1, wherein the timing circuit includes an up counter component and a down counter component.

4. The light control system according to claim 1, wherein the power circuit is at least one of an LED driver and a switch mode power supply.

5. The light control system according to claim 1, wherein the power circuit includes a soft-start component for limiting inrush current to a pre-determined value.

6. The light control system according to claim 1, further comprising a current sense component in electrical communication with the light emitting device and the feedback circuit, wherein the current sense component provides a means for monitoring the electrical characteristics of the light emitting device.

7. The light control system according to claim 6, wherein the current sense component includes at least one resistor and the feedback circuit is adapted to monitor the voltage drop across the at least one resistor.

8. A light control system comprising:

a light emitting device for producing a first light output and a second light output;

a power circuit in electrical communication with the light emitting device for selectively transmitting an electrical current to the light emitting device for controlling the first light output and the second light output;

a timing circuit in electrical communication with the power circuit, wherein the timing circuit generates a pre-determined timing sequence and regulates a duty cycle of the power circuit in response to the timing sequence; and a feedback circuit in communication with the light emitting devices and the timing circuit, wherein the feedback circuit is adapted to monitor an electrical characteristic of the light emitting devices and control the timing sequence of the timing circuit in response to the electrical characteristics of the light emitting devices.

9. The light control system according to claim 8, wherein the first light output has a pre-determined perceived brightness determined by the duty cycle of the power circuit.

10. The light control system according to claim 9, wherein the first light output has a pre-determined perceived brightness which is less than a perceived brightness of the second light output.

11. The light control system according to claim 10, wherein the first light output represents a tail light function of a vehicle and the second light output represents a brake light function of the vehicle.

12. The light control system according to claim 8, wherein the timing circuit includes an up counter component and a down counter component.

13. The light control system according to claim 8, wherein the power circuit is at least one of an LED driver and a switch mode power supply.

14. The light control system according to claim 8, wherein the power circuit includes a soft-start component for limiting inrush current to a pre-determined value.

15. The light control system according to claim 8, further comprising a current sense component in electrical communication with the light emitting device and the feedback circuit, wherein the current sense component provides a means for monitoring the electrical characteristics of the light emitting device.

16. The light control system according to claim 15, wherein the current sense component includes at least one resistor and the feedback circuit is adapted to monitor the voltage drop across the at least one resistor.

17. A method for controlling a duty cycle of a light control system, the method comprising the steps of:

providing a light emitting device for generating a light output;

generating a pre-determined timing sequence and regulating the duty cycle in response to the timing sequence;

transmitting an electrical current to the light emitting device in response to the timing sequence, wherein the light emitting device generates the light output in response to the transmitted electrical current;

monitoring the electrical current flowing through the light emitting device;

generating a feedback signal in response to a pre-determined monitoring threshold based upon the electrical current flowing through the light emitting device; and modifying the timing sequence in response to the feedback signal.

18. The method according to claim 17, wherein the light output has a pre-determined perceived brightness determined by the duty cycle of the transmitted electrical current.

19. The method according to claim 17, further comprising the step of providing a current sense component in electrical communication with the light emitting device, wherein the current sense component provides a means for monitoring an electrical characteristic of the light emitting device.

20. The method according to claim 19, wherein the electrical characteristic is one of a voltage drop across the current sense component and the electrical current flowing through the light emitting device.

* * * * *